US005209161A

United States Patent [19]

Derivi et al.

[11] Patent Number: 5,209,161

[45] Date of Patent: May 11, 1993

[54] METHOD OF MUTUALLY ADJUSTING SINGLE-COLOUR IMAGES ON A MULTICOLOUR ROTARY PRINTING PRESS

[75] Inventors: Ezio Derivi, Ivrea; Domenico Barbero, Villata, both of Italy

[73] Assignee: Officine Meccaniche G. Cerutti S.p.A., Casale Monferrato, Italy

[21] Appl. No.: 732,066

[22] Filed: Jul. 18, 1991

[30] Foreign Application Priority Data

Jul. 20, 1990 [IT] Italy ..... 67573 A/90

[51] Int. Cl.[5] ..... B41F 13/14; B41F 5/06

[52] U.S. Cl. ..... 101/211; 101/181; 101/248; 101/486

[58] Field of Search ..... 101/181, 183, 248, 211, 101/148, 484, 485, 486

[56] References Cited

U.S. PATENT DOCUMENTS 2,444,547 7/1948 Whitehead ..... 101/221
3,221,651 12/1965 Tagliasacchi ..... 101/183
4,833,983 5/1989 Chen ..... 101/181

FOREIGN PATENT DOCUMENTS 2753433 5/1979 Fed. Rep. of Germany .
8214995 3/1983 France .

*Primary Examiner*—J. Reed Fisher
*Attorney, Agent, or Firm*—Klauber & Jackson

[57] ABSTRACT

A method of mutually adjusting single-color images on a rotary printing press for printing multicolor images on a continuous paper strip, each single-color image being printed by a respective printing cylinder adjusted in relation to the other printing cylinders by selecting a reference cylinder from among the printing cylinders; disconnecting the printing cylinder for adjustment from a transmission common to all the printing cylinders; and reconnecting the transmission and the printing cylinder for adjustment, upon the reference cylinder, powered by the transmission, eliminating any difference in timing in relation to the printing cylinder for adjustment. FIGS. 1 and 4).

5 Claims, 4 Drawing Sheets

METHOD OF MUTUALLY ADJUSTING SINGLE-COLOUR IMAGES ON A MULTICOLOUR ROTARY PRINTING PRESS

BACKGROUND OF THE INVENTION

The present invention relates to a method of mutually adjusting single-colour images on a multicolour rotary printing press.

Known multicolour rotary printing presses comprise a number of printing units, one for each colour, arranged side by side and fed one after the other with a continuous strip of paper fed along a given path by a number of printing cylinders, one for each printing unit, each of which provides for printing the paper strip with a given colour ink.

The cylinders on all the printing units are usually powered by the same drive via a transmission for synchronously rotating all the printing cylinders.

On known rotary printing presses of the aforementioned type, the printing cylinders are normally connected in fixed manner to the transmission, and, for achieving the required multicolour image, the single-colour images produced by the respective cylinders are mutually adjusted by means of a guide roller on each printing unit, about which the strip for printing is fed. On each printing unit, the adjusting roller is normally mounted between two fixed guide rollers, so as to define a bend in the path of the paper strip, and is movable in relation to the fixed rollers and across the strip, so as to adjust the length of the bend and, with the press running, adjust the single-colour image produced on the printing unit with a corresponding image printed on the upstream unit.

The above method of mutually adjusting or timing the single-colour images presents a number of drawbacks, not only due to the relatively complex mechanical design of the devices regulating the position of the movable adjusting rollers, but also on account of the length of the path of the paper strip and the time required for making the adjustment.

In connection with the above, it should be pointed out that, on a rotary printing press, each bend for adjusting the strip increases its path by about one meter, thus increasing the risk of the strip tearing during printing and the time required for resetting the torn strip. What is more, as adjustment is made with the press running, and transverse displacement of the adjusting rollers is necessarily slow to prevent inducing undue transient stress on the strip, the amount of printed matter rejected during adjustment is normally considerable.

SUMMARY OF THE INVENTION

It is an object of the present invention to provide a method of adjusting single-colour images on a multicolour rotary printing press, designed to overcome the above drawbacks.

According to the present invention, there is provided a method of mutually adjusting single-colour images on a multicolour rotary printing press, said single-colour images being printed on a continuous strip by respective printing cylinders on respective printing units arranged in series along the path of said strip and series connected to a single transmission powering said printing cylinders; characterised by the fact that it comprises stages consisting in selecting a reference cylinder from among said printing cylinders; disconnecting said transmission and the printing cylinder for adjustment; and reconnecting said transmission and said printing cylinder for adjustment upon said reference cylinder, powered by said transmission, eliminating any difference in timing in relation to said printing cylinder for adjustment.

The above adjustment, which is repeated for all the printing cylinders with the exception of the reference cylinder, may obviously be made with the press running and with or without the paper strip, and provides for eliminating the formation of sizable bends in the path of the paper strip.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Number 1 in the accompanying drawings indicates a multicolour rotary printing press.

Figure 1:
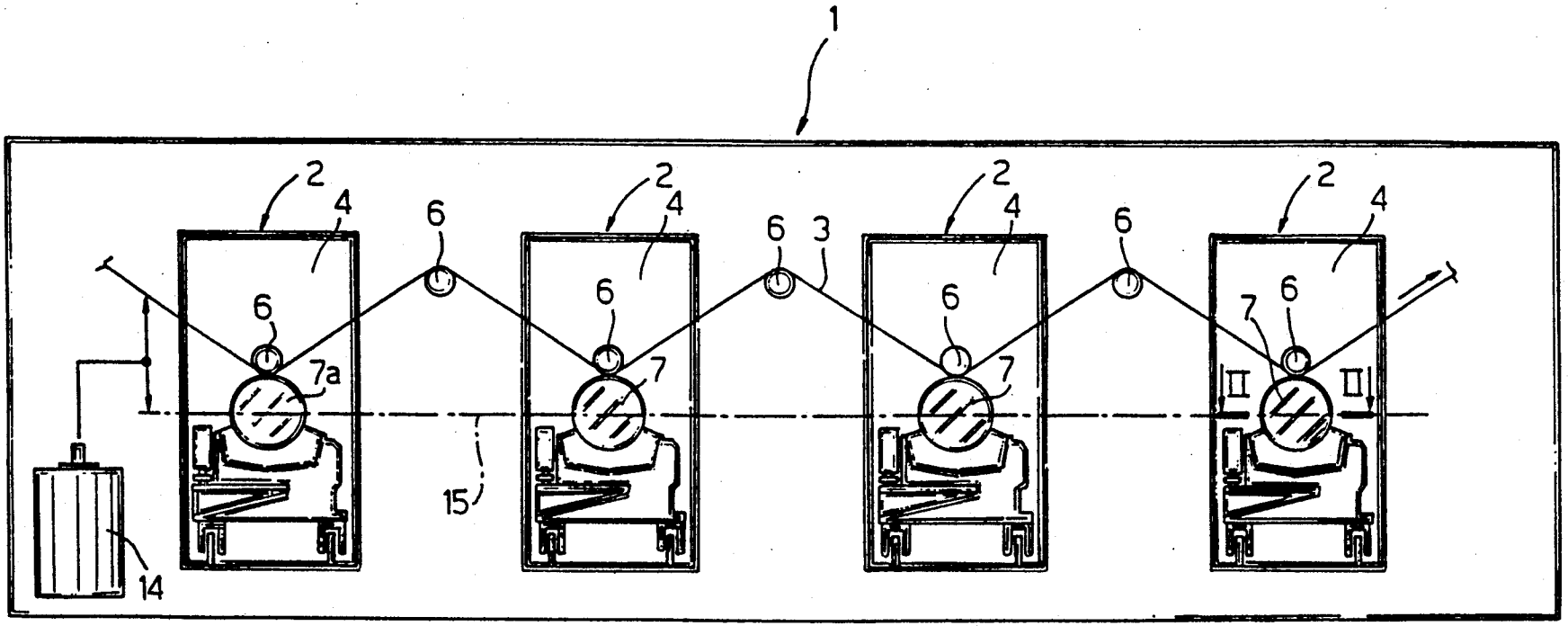
FIG. 1 shows a schematic, partial side view, with parts removed for simplicity, of a printing press implementing the method according to the present invention.

As shown in FIG. 1, press 1 comprises a number of printing units 2 aligned along the path of a paper strip 3, and each providing for printing said strip 3 with a given colour ink.

Each unit 2 comprises a load-bearing element consisting of a gantry 4 having two uprights 5 between which are mounted for rotation a number of guide rollers 6. Each unit 2 also comprises a printing cylinder 7 located between uprights 5, parallel to guide rollers 6 and perpendicular to the path of strip 3. One of cylinders 7 (7*a* in FIG. 1) acts a reference cylinder in relation to which the other cylinders 7 are timed. Each cylinder 7 is supported on uprights 5, tangent to the path of strip 3, by means of two suspension devices 8 (FIG. 2 onwards), each having an end member consisting of a support 9 for a respective bush 10 connected for rotation to a shaft 12 via the interposition of a bearing 11. Shaft 12 is integral and coaxial with respective cylinder 7, and presents an axis 13 perpendicular to the FIG. 1 plane and constituting the rotation axis of cylinder 7.

Figure 2:
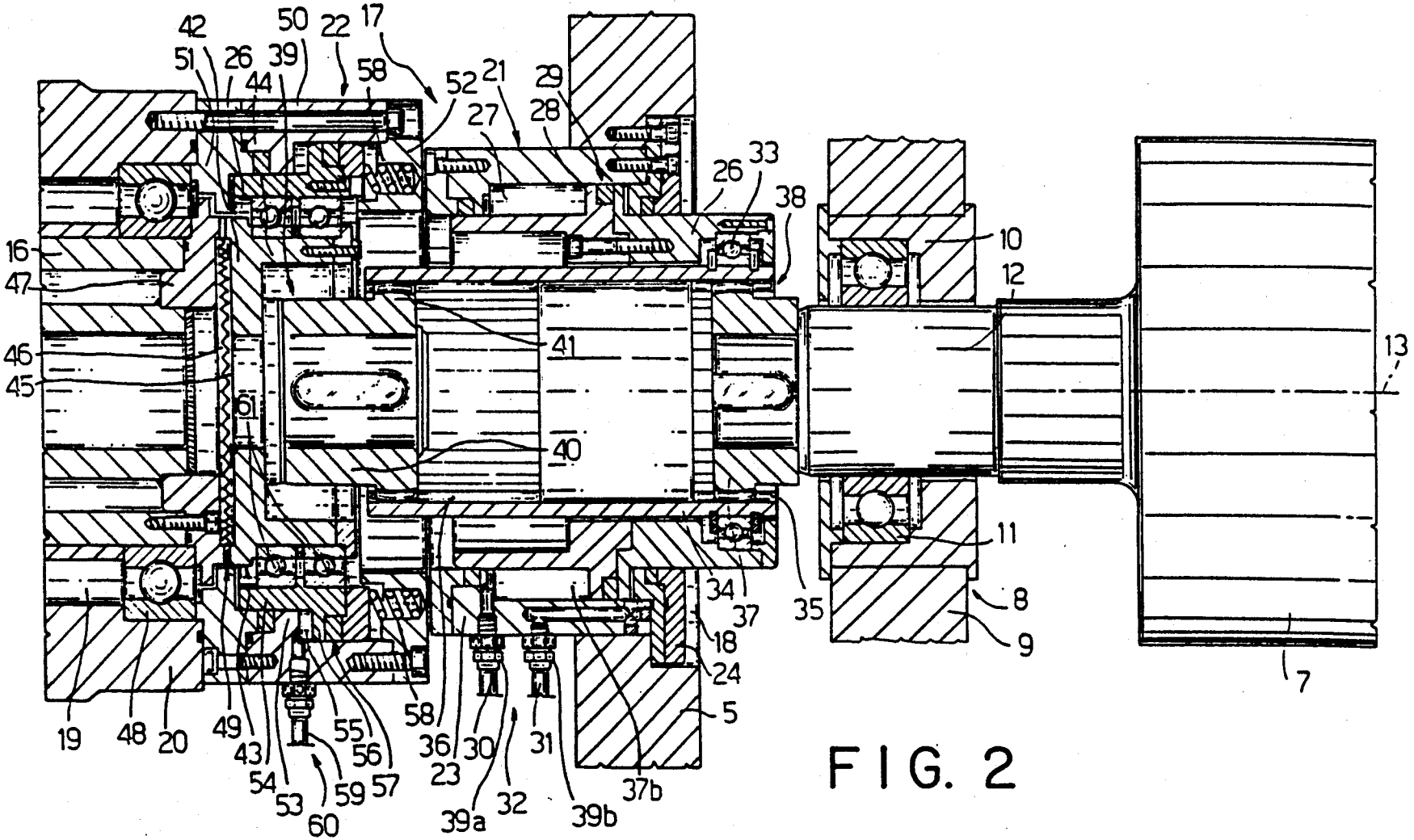
FIG. 2 shows a larger-scale section along line II—II in FIG. 1, with parts removed for simplicity.

As shown in FIG. 1, press 1 comprises a drive 14 connected to all of printing units 2 via a main transmission 15 for synchronizing all of cylinders 7. As shown in FIG. 2, for each unit 2, transmission 15 presents an outputs shaft 16 connected to cylinder 7 by a connecting and timing unit 17 coaxial with axis 13 and extending through a hole 18 in upright 5, and a hole 19 coaxial with hole 18 and axis 13, and formed through a further fixed load-bearing element 20 parallel to and facing said upright 5.

As shown in FIG. 2, unit 17 of each printing unit 2 comprises two pneumatic actuators 21 and 22, the first extending through hole 18 towards element 20 and integral with upright 5, and the second extending coaxially with hole 19 towards upright 5 and integral with element 20.

Pneumatic actuator 21 comprises a cylindrical outer body 23 extending through hole 18 and closed at opposite ends by two annular covers 24 and 25 integral with body 23 and the first of which is connected integral with upright 5. Through the central holes in covers 24 and 25, there is mounted in sliding manner a tubular coupling 26 defining, with sylindrical body 23 and covers 24 and 25, an annular chamber 27 engaged in sliding and fluidtight manner by a flange 28 extending radially outwards from an intermediate point on coupling 26. Flange 28, together with coupling 26, defines a piston 29 moved reciprocatingly inside chamber 27 by a pneumatic fluid fed selectively into the opposite ends of chamber 27 by two injectors 30 and 31 of a pneumatic circuit 32.

Via the interposition of a bearing 33, coupling 26 is fitted inside with a rotary, axially-fixed, tubular transmission member 34 projecting from the end of coupling 26 facing actuator 22, fitted inside actuator 22, and having two splined inner end portions 35 and 36, the first of which arranged facing cylinder 7. On the end facing tubular member 34, shaft 12 is fitted with a straight-toothed gear 37 which, in the operating position shown in FIG. 2, engages splined portion 35 of tubular member 34 in sliding and angularly-fixed manner, so as to define, with splined portion 35, a first joint 38 connecting shaft 16 and cylinder 7.

Figure 3:
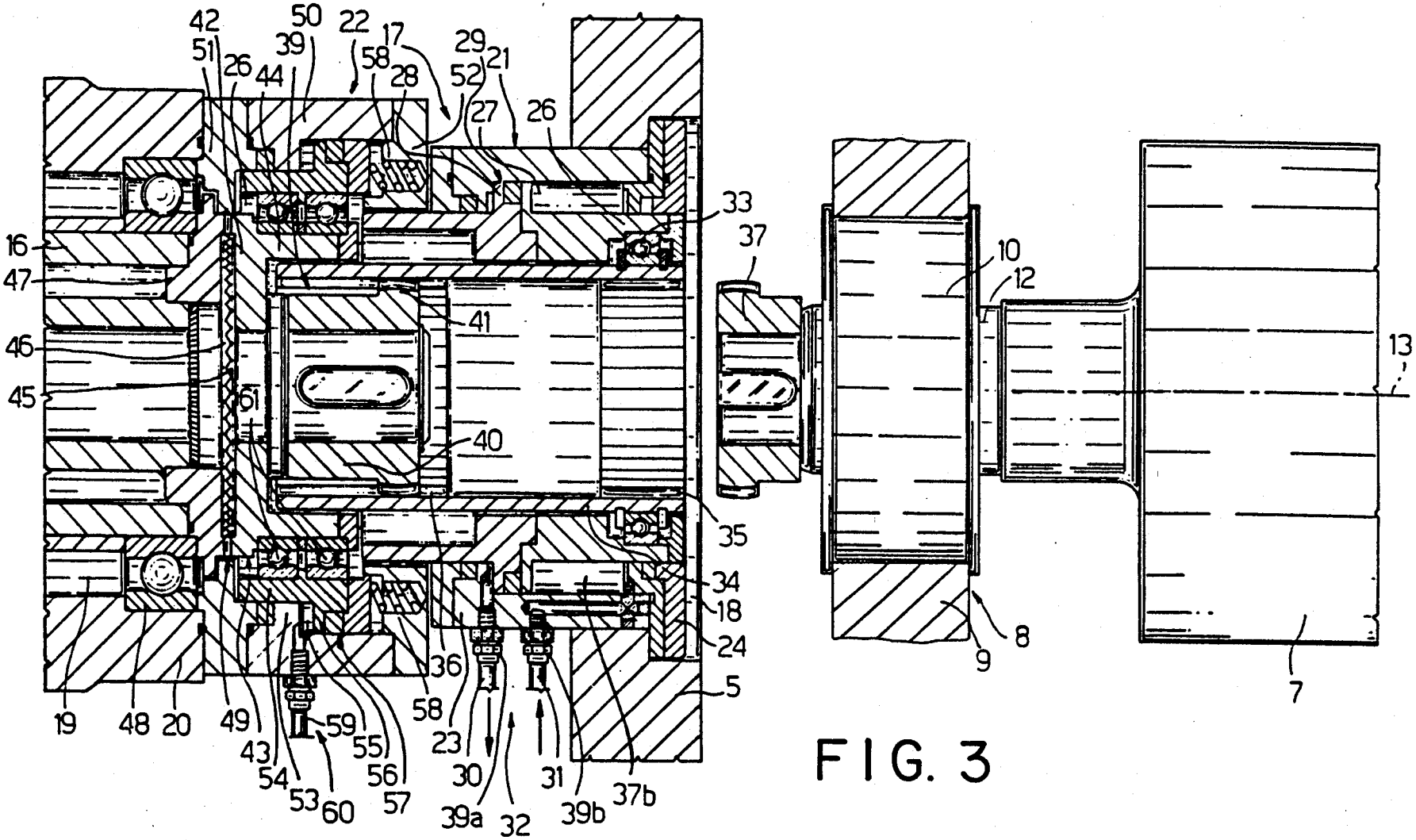
FIGS. 3 and 4 show the FIG. 2 section in two different operating positions.

As shown in FIGS. 2 and 3, piston 29 is designed to move between a forward operating position (FIG. 2) wherein gear 37 engages splined portion 35 of tubular member 34, thus engaging joint 38; and a withdrawn idle position (FIG. 3) wherein gear 37 is fully clear of tubular member 34, thus releasing joint 38.

Tubular member 34 is fitted through with a further transmission member 39 comprising a central shaft 40 coaxial with axis 13 and having a first end portion facing cylinder 7 and fitted with a straight-toothed gear 41 connected in sliding manner to splined portion 36 of tubular member 34; and a second end portion facing shaft 16 and connected integral with the end wall 42 of a cup-shaped body 43 comprising a cylindrical lateral wall 44 extending from the outer edge of end wall 42 towards upright 5 and connected axially to actuator 22. The surface of wall 42 facing shaft 16 presents annular front teeth 45 meshing, in the FIG. 2 operating position, with corresponding front teeth 46 formed on an annular plate 47 connected integral with the end of shaft 16, which is supported for rotation on element 20 inside hole 19 and via the interposition of a bearing 48.

Transmission member 39 and shaft 16, and particularly front teeth 45 and 46 integral with the same, define a second joint 49 connecting shaft 16 and cylinder 7.

Figure 4:
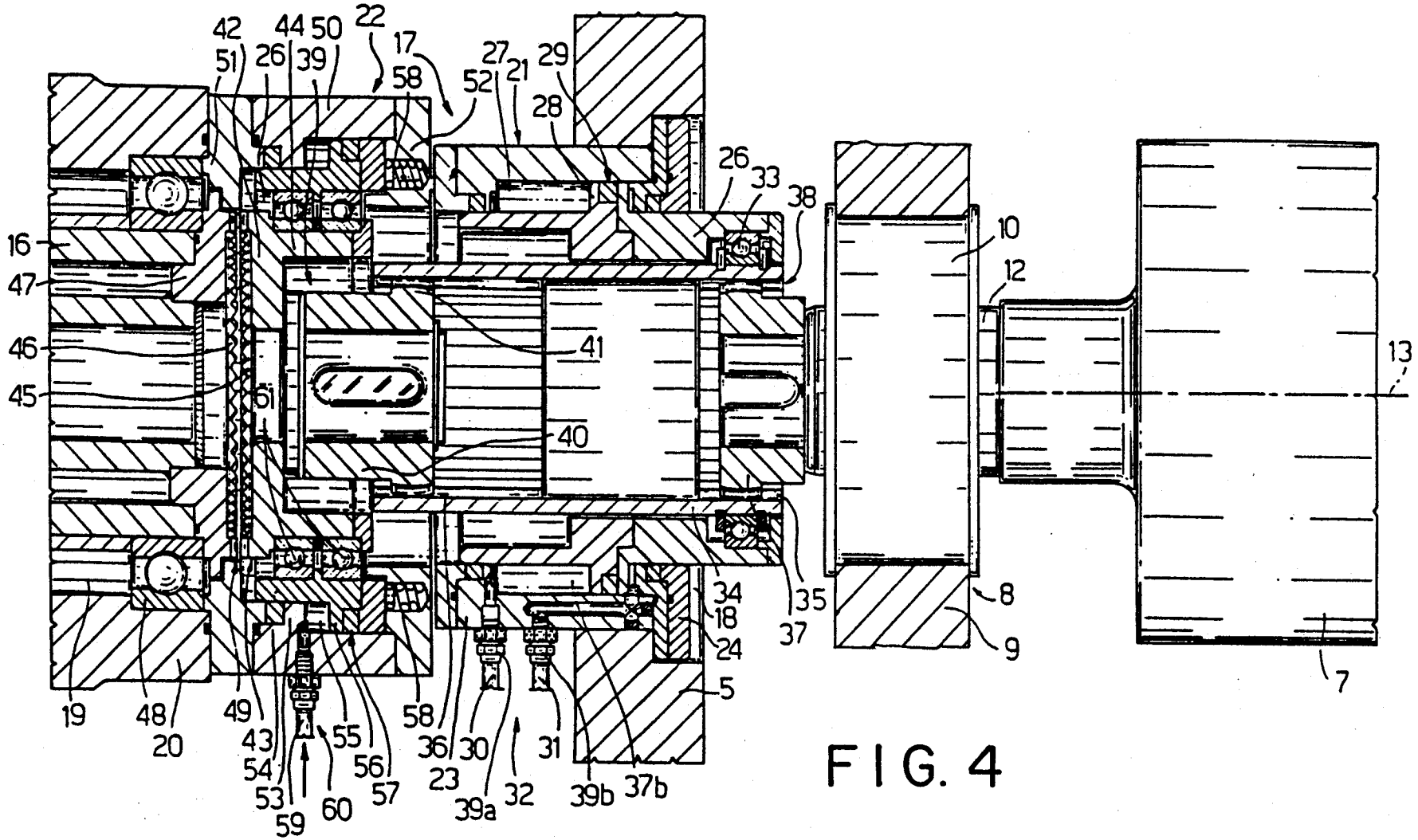

As shown in FIGS. 2 and 4, while remaining angularly connected to tubular member 34, cup-shaped body 43 is moved by actuator 22 between a forward operating position (FIG. 2) wherein teeth 45 and 46 mesh, thus engaging joint 49; and a withdrawn idle position (FIG. 4) wherein teeth 45 and 46 are axially detached, thus releasing joint 49.

As shown in FIG. 2, axial displacement of transmission member 39 between said two positions is made possible by actuator 22 comprising a cylindrical outer body 50 closed at opposite ends by two annular covers 51 and 52 integral with body 50, and the first of which is connected integral with element 20 and coaxially with hole 19. The central through hole of an annular inner flange 53 on cylindrical body 50 is fitted through in sliding manner with a tubular coupling 54 defining, with cylindrical body 50, cover 52 and flange 53, an annular chamber 55 engaged in sliding and fluidtight manner by a flange 56 extending radially outwards from one end of coupling 54. Together with coupling 54, flange 56 defines a piston 57 moved reciprocatingly inside chamber 55, against the thrust of axial return springs 58, by a pneumatic fluid fed into one end of chamber 55 by injector 59 of a pneumatic circuit 60. Cylindrical wall 44 of cup-shaped body 43 is mounted in rotary and axially-fixed manner inside coupling 54, via the interposition of bearings 61.

In actual use, the angular position of each cylinder 7 can be adjusted in relation to reference cylinder 7*a* regardless of whether strip 3 is assembled or not. With strip 3 assembled, however, press 1 is run at relatively slow speed to enable adjustment to be made with a minimum of waste strip 3.

For making the adjustment, after determining, either mathematically or on the printed strip itself, the difference in timing of one printing cylinder 7 in relation to reference cylinder 7*a*, joint 38 is released by feeding pressurized fluid into chamber 55. Despite the force exerted by axial springs 58, said pressurized fluid moves transmission member 39 from the FIG. 2 operating position, wherein front teeth 45 and 46 are engaged, to the released position shown in FIG. 4, wherein front teeth 45 and 46 are detached, thus preventing torque transmission to and, consequently, rotation of printing cylinder 7. By maintaining pressurized fluid supply to chamber 55, said released position is maintained for as long as it takes for the rest of the press, in particular cylinder 7*a*, to compensate for the initial difference in timing. At this point, the pressurized fluid supply to chamber 55 is cut off, and axial springs 58 restore piston 57 to the operating position wherein front teeth 45 and 46 are engaged.

During the timing operation, the first joint 38 is kept engaged for maintaining the position assumed by cylinder 7 being adjusted.

The above operation is repeated for each of cylinders 7 to achieve a multicolour image composed of perfectly timed single-colour images in relation to strip 3.

We claim:

1. A method of mutually adjusting single-colour images on a multicolour rotary printing press (1), said single-colour images being printed on a continuous strip (3) by respective printing cylinders (7) on respective printing units (2) arranged in series along the path of said strip (3) and series connected to a single transmission (15) powering said printing cylinders (7); wherein said method comprises stages consisting in selecting a reference cylinder (7*a*) from among said printing cylinders (7); disconnecting said transmission (15) and one of said printing cylinder (7) for adjustment; and reconnecting said transmission (15) and said disconnected printing cylinder (7) for adjustment upon said reference cylinder (7*a*), powered by said transmission (15), eliminating any difference in timing in relation to said disconnected printing cylinders (7) for adjustment; wherein each said printing cylinder (7) is disconnected and connected to said transmission (15) by means of a connecting and timing unit (17) located between a respective printing cylinder (7) and said transmission (15), each said connecting and timing unit (17) comprises first (38) and second (49) connecting means arranged in series for transmitting a torque to a respective said printing cylinder (7); said disconnection and said connection involving only one of said connecting means (38, 49); wherein, for each said printing unit (2), said transmission (15) comprises an output shaft (16) coaxial with a respective said printing cylinder (7); each said connecting and timing unit (17) comprising a first (21) and second (22)

pneumatic actuator for said first (38) and second (49) connecting means respectively; and second connecting means (49) being connected to said output shaft (16), and said second actuator (22) being activated for effecting said disconnection and said connection; and wherein each said first pneumatic actuator (21) is a double-acting actuator comprising a cylinder (23) and a piston (29) moving inside said actuating cylinder (23) between a first and second position; said piston (29) comprising an inner tubular member (34) coaxial with and rotating about its axis in relation to said actuating cylinder (23); said tubular member (34) presenting a splined inner portion (35); key means (37) being provided on a respective said printing cylinder (7); said key means (37) being connected to and disconnected from said splined portion (35) of said tubular member (34) when said piston (29) is set respectively to said first and said second position; and said key means (37) defining, with said splined portion (35), said first connecting means (38).

2. A method as claimed in claim 1, wherein said adjustment is made with said strip (3) assembled.

3. A method as claimed in claim 1, wherein said second pneumatic actuator (22) comprises a cylinder (50) and a piston (57) moving inside said second pneumatic actuator cylinder (50) between a first and second position; said piston (57) comprising an inner element (43) coaxial with and rotating about its axis in relation to said second pneumatic actuator cylinder (50); said inner element (43) being connected in sliding and angularly-fixed manner to said tubular member (34); first (46) and second (45) front teeth being arranged facing each other, being supported respectively on said output shaft (16) and said inner element (43), and being respectively engaged and released upon said second pneumatic actuator piston (57) moving into said first and said second position; said front teeth (45, 46) defining said second connecting means (49).

4. A method as claimed in claim 1, wherein, for each said printing unit (2), said single transmission (15) comprises an output shaft (16), and each of said printing cylinders (7) comprises a drive shaft (12) coaxial therewith, and wherein the connecting and timing unit (17) is coaxial with both said output shaft (16) and said drive shaft (12).

5. A method as claimed in claimed 1, wherein said first connecting means (38) coaxially connects the connecting and timing unit (17) to a respective said printing cylinder (7) and said second connecting means (49) coaxially connects the connecting and timing unit (17) to said output shaft (16).

* * * * *